United States Patent [19]

Cohart

[11] Patent Number: 5,074,067

[45] Date of Patent: Dec. 24, 1991

[54] MAT STRUCTURE AND METHOD OF MATTING A PICTURE

[76] Inventor: Richard M. Cohart, 851 O'Farrell St., Apt. 206 San Francisco, Calif. 94109

[21] Appl. No.: 459,053

[22] Filed: Dec. 29, 1989

[51] Int. Cl.[5] ..... B44C 5/02; G09F 1/12

[52] U.S. Cl. ..... 40/158.1; 40/152

[58] Field of Search ..... 40/158.1, 156, 152.1, 40/152, 159, 155, 27.5

[56] References Cited

U.S. PATENT DOCUMENTS

| | | | |
|---|---|---|---|
| 154,581 | 9/1874 | Bushnell | 40/158.1 |
| 452,911 | 5/1891 | Bainbridge | 40/158.1 |
| 1,358,916 | 11/1920 | Anderson | 40/158.1 |
| 2,092,348 | 9/1937 | Cross | 40/152 |
| 2,172,273 | 9/1939 | Chilcote | 40/152.1 |
| 2,179,699 | 11/1939 | McKeown | 40/152 |
| 2,240,209 | 4/1941 | Cross | 40/152.1 |
| 2,458,349 | 1/1949 | Cross . | |
| 2,603,018 | 7/1952 | Cross | 40/152.1 |
| 2,984,922 | 5/1961 | Ladenburger et al. | 40/158.1 |
| 3,188,762 | 6/1965 | Morrill . | |
| 3,382,595 | 5/1968 | Shore | 40/158.1 |
| 3,444,638 | 5/1969 | Jahn | 40/158.1 |
| 3,707,053 | 12/1972 | Itano | 40/158.1 |
| 3,787,992 | 1/1974 | Leonhardt | 40/152 |
| 3,813,799 | 6/1974 | Caravello | 40/152 |
| 4,378,647 | 4/1983 | Stancato . | |

FOREIGN PATENT DOCUMENTS

| | | | |
|---|---|---|---|
| 3005328 | 9/1980 | Fed. Rep. of Germany | 40/156 |
| 805199 | 11/1936 | France | 40/158.1 |
| 910102 | 11/1962 | United Kingdom | 40/158.1 |

*Primary Examiner*—Kenneth J. Dormer
*Assistant Examiner*—J. Bonifanti
*Attorney, Agent, or Firm*—Skjerven, Morrill, MacPherson, Franklin & Friel

[57] ABSTRACT

A mat structure and method of matting, wherein, in one embodiment, a first mat is formed having a first opening. A second mat is formed having an opening smaller than the first opening in the first mat. A third mat is formed having an opening corresponding to the outer dimensions of the second mat and corresponding to the dimensions of a picture to be matted. A backing member is secured to the third mat. A picture is positioned within the opening in the third mat so that, when the second mat is positioned over the third mat, the picture is secured in place by the second mat opposing the backing member through the opening in the third mat. The first mat is then placed over the second mat.

10 Claims, 3 Drawing Sheets

MAT STRUCTURE AND METHOD OF MATTING A PICTURE

FIELD OF THE INVENTION

This invention relates to an improved method and structure for matting pictures, and in particular to an improved method and structure for matting pictures to achieve proper alignment of the picture with respect to the mat.

BACKGROUND OF THE INVENTION

In the matting of a picture, in order to have the picture bordered by a mat to create an aesthetically pleasing effect, it is conventional for one to align the picture with respect to an opening formed in a front mat and then adhesively secure the aligned picture to the back surface of the front mat. Frequently, this is a difficult task, since the picture must first be viewed through the opening in the mat to align the picture, and then the picture must not be moved while it is being adhesively secured to the back surface of the mat. For larger prints or pictures, this becomes increasingly difficult.

A further drawback of the above method of matting is that the adhesive used to secure the picture to the mat frequently mars the picture if the picture is subsequently removed from the mat.

What is needed is an inexpensive and convenient way for aligning pictures with respect to an opening in a mat which does not require the user to tape or otherwise adhesively secure the picture to the back surface of the mat.

SUMMARY OF THE INVENTION

A mat structure and method of matting is disclosed which enables one to mat a picture without the use of adhesives and without the problem of holding the picture in place after aligning the picture with the opening in the mat.

In this novel structure, a front mat having outer dimensions larger than a picture to be mounted is formed with a basically centered opening. A second mat is formed to have an opening equal to or smaller than the opening in the front mat and to have outer dimensions identical to the size of the picture to be matted. A third mat of a size identical to the front mat has an opening with dimensions identical to the outer dimensions of the second mat and, thus has an opening identical to the size of the picture to be matted.

A solid back-side mat is secured to the back surface of the third mat so that the opening in the third mat forms a well. The picture, having identical dimensions as the well, is placed within the well.

The second mat is placed over the picture in the well. Since the dimensions of the second mat are equal to the dimensions of the well, the second mat fits perfectly within the well and secures the picture to the back-side mat by pressure or restraint alone.

The front mat is placed over the second mat so that a back surface of the front mat is flush with top surfaces of the second mat and third mat.

Preferably, the second and third mats are formed from a single mat so that the same matting material is used in this novel structure as for double matting a picture using conventional matting techniques, where the double matting provides an inner mat border.

The resulting matting structure may then be framed.

BRIEF DESCRIPTION OF THE DRAWINGS

FIG . 1 shows a front view of an outer border mat used in the preferred embodiment of the invention.

DETAILED DESCRIPTION OF THE INVENTION

Figure 1:
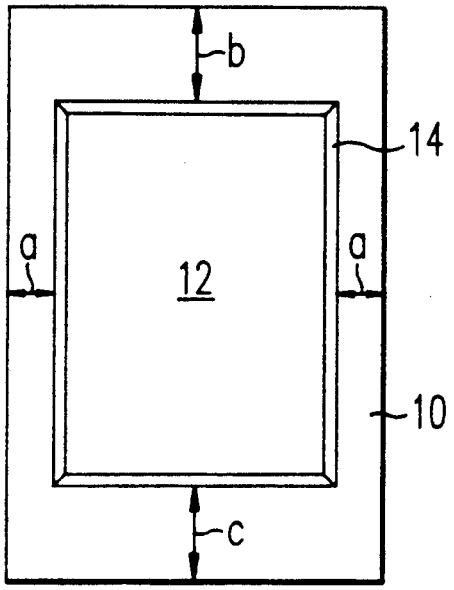

FIG. 1 shows a conventional mat of the type comprising a plurality of laminations, which include an attractively textured front layer secured by means of an appropriate adhesive to a central filler layer which is of generally greater thickness and comprised of a more inexpensive paper material. This mat will be referred to as outer border mat 10. In outer border mat 10, an opening 12 is formed which may be of any shape, but is shown in FIG. 1 as rectangular. Preferably, opening 12 is formed to have bevelled edges 14 for a more aesthetically pleasing effect and is formed using a guided razor means of the type typically used to cut mat openings. In FIG. 1, outer border mat is shown to have left and right borders of width "a," an upper border of width "b," and a bottom border of width "c. "

Generally, it is more aesthetically pleasing to provide a double mat structure for a picture, where the double mat comprises an outer border mat having a first opening, such as opening 12, and an inner border mat having a smaller opening through which the matted picture is viewed.

Figure 2:
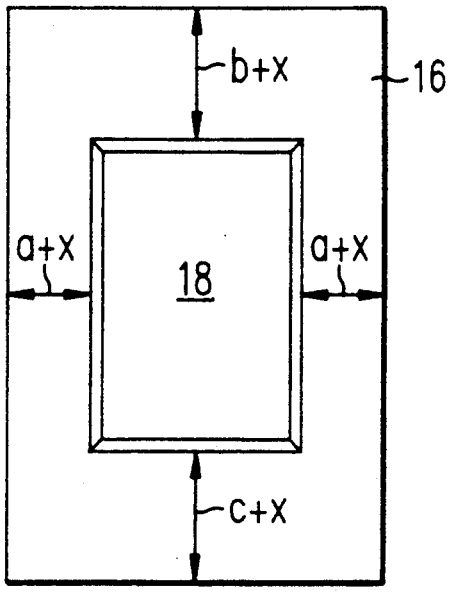
FIG. 2 is a front view of an inner border mat used in the preferred embodiment of the invention.

In FIG. 2, inner border mat 16 is shown having inner border opening 18 cut out using a conventional guided razor means. Preferably, inner border opening 18 is made smaller than opening 12; however, inner border opening 18 may be made to have approximately the same dimensions as opening 12, or even larger dimensions, if desired. The outer edge dimensions of inner border mat 16 are preferably identical to the dimensions of outer border mat 10. In a preferred embodiment, the widths of the borders of inner border mat 16 are greater than the widths of the borders of outer border mat 10 by increment "x," as shown in FIG. 2. Preferably, the edges of inner border opening 18 are bevelled similar to bevels 14 of opening 12.

In the prior art, to achieve a double matting effect, inner border mat 16 would be adhesively secured to the back surface of outer border mat 12 after aligning inner border opening 18 with opening 12. A picture would then be visually aligned with the inner border opening 18 and adhesively secured to the back of inner border mat 16. The resulting structure would then be placed on a backing material and framed. In the inventive structure described herein, the step of visually aligning the picture within inner border opening 18 and adhesively securing the picture to the back of inner border mat 16 is avoided. FIGS. 3–6 illustrate the structure and steps necessary to achieve these advantages.

Figure 3:
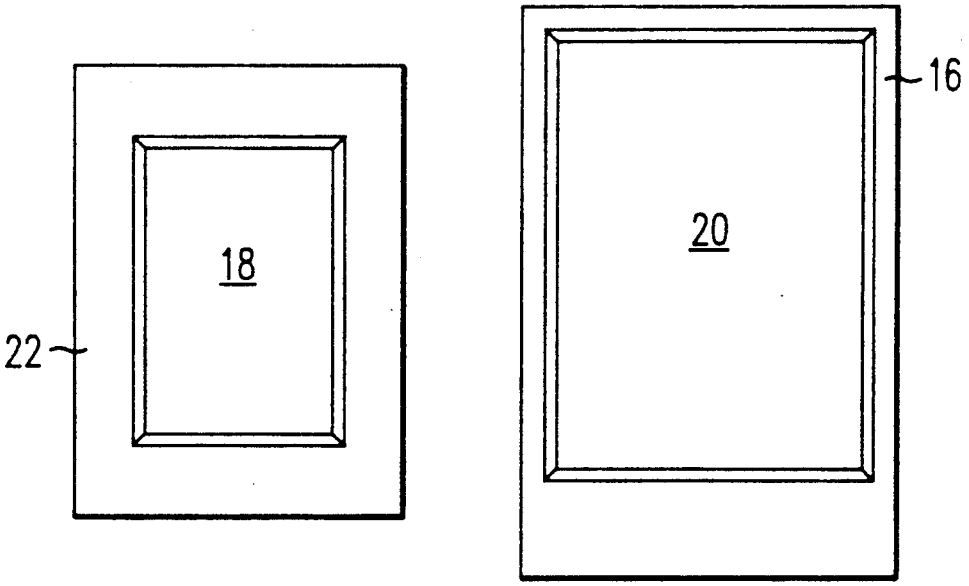
FIG. 3 is a perspective view of the inner border mat after undergoing a cutout operation.

In FIG. 3, inner border mat 16 is shown having a central section cut out using a conventional guided razor means typically used for cutting mat openings. The resulting opening 20 in inner border mat 16 after removal of inner border mat cutout 22 is made to have identical dimensions as the outer dimensions of the picture to be matted.

In the preferred matting method, to determine the dimensions of opening 20, the picture to be matted is simply positioned over inner border mat 16, and the corners of the picture are marked with a suitable means, such as a pencil. A guided razor is then used to form opening 20 corresponding to the size of the picture In a commercial embodiment, opening 20 would be precut to conform with various standard sizes of pictures Preferably, the edges of opening 20 are bevelled inward toward opening 20.

Figure 4:
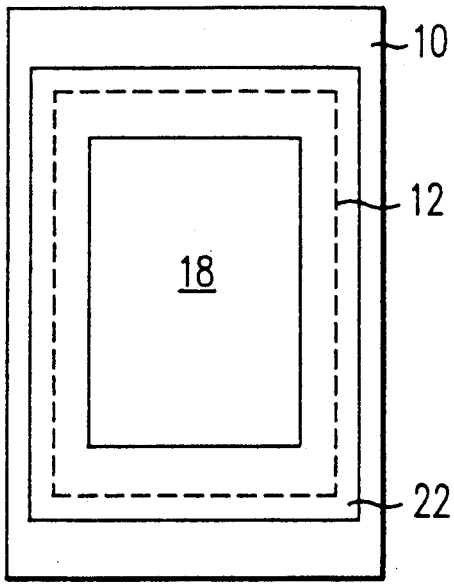
FIG. 4 is a back view of the outer border mat of FIG. 1 after the cutout portion of the inner border mat is secured thereon.

In FIG. 4, inner border mat cutout 22 is shown secured to the back of outer border mat 10, where opening 18 is aligned with opening 12. Opening 12 of outer border mat 10 is shown in dashed outline Preferably, an adhesive, such as double-sided tape, is used to secure cutout 22 to mat 10.

Figure 5:
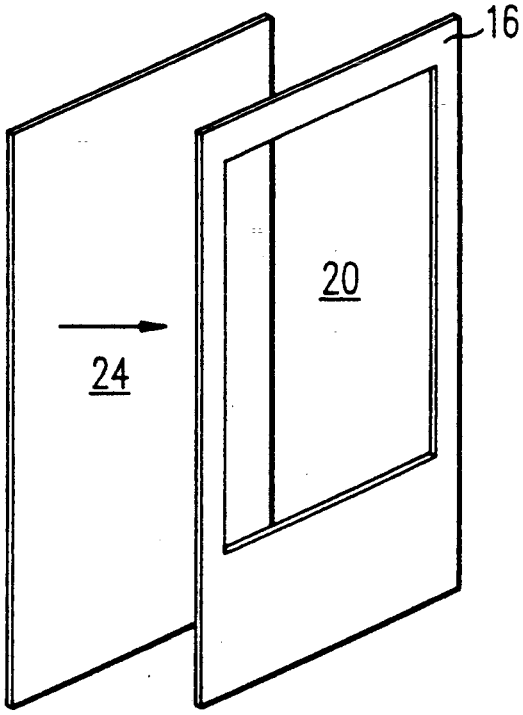
FIG. 5 is a perspective view of the mounting of a backing member onto the inner board mat.

Referring to FIG. 5, a backing member 24, having outer dimensions identical to the outer dimensions of inner border mat 16, is adhesively secured to the back of inner border mat 16. Opening 20 in inner border mat 16 thus forms a well having dimensions identical to the picture to be matted.

Figure 6:
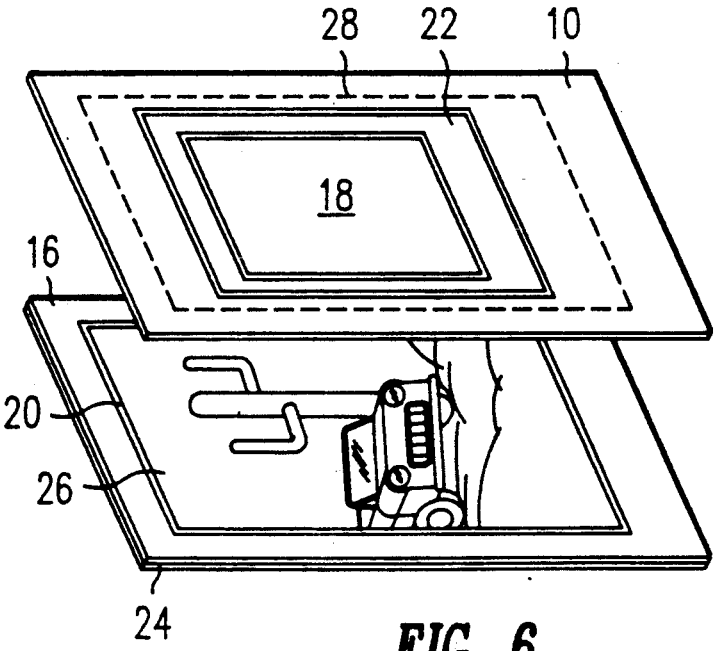
FIG. 6 shows the mounting of the outer border mat, having the cutout portion of the inner border mat secured thereon, onto the inner border mat, where a well in the inner border mat contains a picture which is to be secured in place by resulting mat structure.

FIG. 6 is a perspective view showing backing member 24 secured to the back of inner border mat 16 and picture 26 simply placed in the well created by opening 20. Outer border mat 10, having inner border mat cutout 22 secured thereon, is placed over the front surface of inner border mat 16 so as to align inner border mat cutout 22 with opening 20. Since the dimensions of opening 20 necessarily matches the outer dimensions of inner border mat cutout 22, outer border mat 10 will fit flush against the surface of inner border mat 16, and the edges of picture 26 will be firmly secured between backing member 24 and inner border mat cutout 22. In FIG. 6, the edges of inner border mat cutout 22, obscured by outer border mat 10, are shown by dashed outline 28.

If picture 26 is desired to be removed from the mat structure at a later time, there is no adhesive to be removed from picture 26, and picture 26 will not be marred. By using this inventive structure, picture 26 is perfectly aligned with inner border opening 18, and no additional mat materials are necessary other than those which would be necessary for a conventional double matting.

This preferred embodiment structure and method can of course be applied to mats and mat openings having various shapes and sizes.

Figure 7:
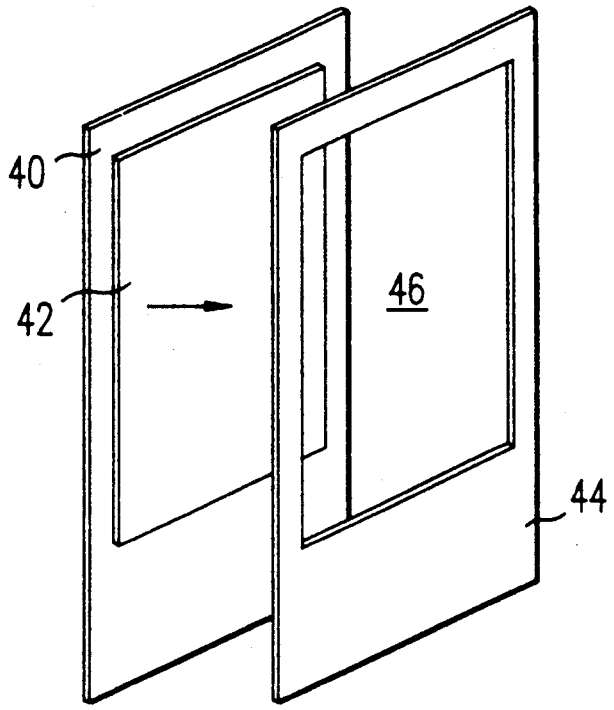
FIG. 7 is a perspective view of a backing member and an intermediate mat used in an alternate embodiment of the invention.

In an additional embodiment of the invention, a backing member 40, shown in FIG. 7, has formed in it a raised portion 42 having dimensions approximately equivalent to a picture to be matted. Preferably, raised portion 42 is formed by a stamping process or by other suitable means. Alternatively, raised portion 42 may be a separate mat secured to backing member 40. Preferably, the height of raised portion 42 is approximately equal to one-half to three-quarters the thickness of the mats which will be utilized in this embodiment.

Also shown in FIG. 7 is intermediate mat 44 having an opening 46 with dimensions approximately equivalent to a picture to be matted and, thus, equivalent to the dimensions of raised portion 42. Opening 46 is formed such that, when intermediate mat 44 is placed over backing member 40, opening 46 aligns with raised portion 42. Consequently, when intermediate mat 44 is placed over backing member 40, raised portion 42 slightly protrudes into opening 46 and forms a well having dimensions approximately equivalent to the picture to be matted.

Figure 8:
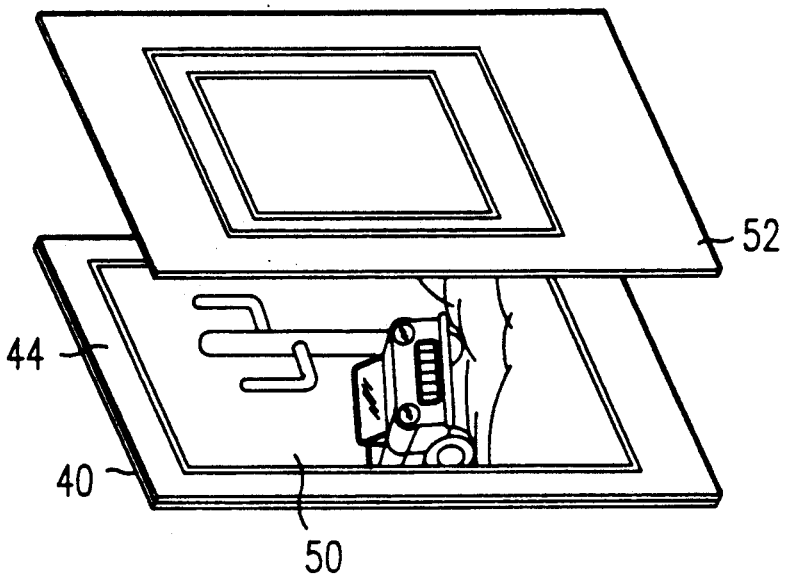
FIG. 8 shows the mounting of a picture using the backing member and intermediate mat of FIG. 7 in conjunction with a standard double mat.

FIG. 8 shows picture 50 positioned in opening 46 and on top of raised portion 42 after intermediate mat 44 is placed on top of backing member 40.

A standard single mat, such as shown in FIGS. 1 or 2, or a double mat (FIG. 8 shows double mat 52 being used) formed by, for example, securing the mat of FIG. 2 to the back of the mat of FIG. 1, is then placed over intermediate mat 44 such that picture 50 is restrained in position by the back of mat 52 and the boundaries of opening 46. The resulting structure may then be framed for hanging without the requirement of adhesively securing the picture to a backing member.

The specific embodiments herein described are only illustrative of the invention. Other embodiments using the above-described concepts are also intended to be encompassed by the invention. Various other changes in structure may additionally occur to those skilled in the art, and all of these changes are to be understood as forming a part of the invention insofar as they fall within the true spirit and scope of the following claims.

What is claimed is:

1. A mat structure for providing a border around a picture, said mat structure comprising:

a first mat having a first opening;

a second mat having outer dimensions, said second mat having a second opening, said second opening being substantially equal to or smaller than said first opening, said second opening being aligned with said first opening when said second mat is positioned against a back surface of said first mat;

a third mat having a third opening extending through an entire thickness of said third mat, said third opening having dimensions approximately equivalent to said outer dimensions of said second mat, said dimensions of said third opening also being approximately equivalent to outer dimensions of a picture to be matted; and a backing member having a top surface on which said third mat is positioned thereon so that a bottom surface of said third mat directly abuts said top surface of said backing member, said backing member with said third mat being positioned thereon being such that said second mat, when placed within said third opening, directly abuts said top surface of said backing member, said second mat being positioned within said third opening so that said second mat opposes said backing member through said third opening with any picture therebetween, said first mat being positioned over said second mat to align said first and second openings.

2. The structure of claim 1 wherein a picture having dimensions approximately equivalent to said third opening is positioned within said third opening and secured in position by said second mat opposing said backing member.

3. The structure of claim 1 wherein said first opening and said second opening have bevelled edges.

4. The structure of claim 1 wherein said third opening has bevelled edges, and outer edges of said second mat have bevelled edges which coincide with said bevelled edges of said third opening when said second mat opposes said backing member.

5. The structure of claim 1 wherein said dimensions of said third opening are larger than dimensions of said first opening.

6. The structure of claim 1 wherein said backing member is adhesively secured to said third mat, and said second mat is adhesively secured to said first mat.

7. A method of matting a picture comprising the steps of:

cutting a first opening in a first mat;

cutting a second copending in a second mat, said second opening being substantially equal to or smaller than said first opening;

cutting a third opening in said second mat extending through an entire thickness of said second mat, said third opening having dimensions approximately equivalent to a picture to be matted, said step of cutting said third opening resulting in a third mat to become separated from said second mat, said third mat having said second opening formed therein;

positioning said second mat on a backing member so that a bottom surface of said second mat directly abuts a top surface of said backing member;

positioning said picture to be matted within said third opening so as to directly abut against said top surface of said backing member;

positioning said third mat within said third opening so that said third mat opposes said picture positioned within said third opening; and positioning a back surface of said first mat against a top surface of said third mat so as to align said second opening with said first opening.

8. The method of claim 7 further comprising the step of securing said second mat to a backing member after said step of forming said third opening so that said step of positioning said third mat within said third opening results in said picture being held in place between said backing member and said third mat.

9. A mat structure for providing a border around a picture, said mat structure comprising:

backing member having a raised portion, said raised portion having dimensions corresponding to outer dimensions of a picture to be matted;

an intermediate mat having a first opening, said first opening having dimensions corresponding to said outer dimensions of said picture to be matted, a thickness of said intermediate mat being greater than a height of said raised portion, said intermediate mat being placed over said backing member so as to cause said raised portion to be partially inserted through said first opening to thereby form a well for placement of said picture thereinto; and a top mat having a second opening, said second opening having dimensions smaller than said first opening said top mat being placed over said intermediate mat for restraining said picture within said well.

10. The mat structure of claim 9 wherein said top mat comprises a double mat and wherein said second opening forms an inner border of said double mat.

* * * * *

UNITED STATES PATENT AND TRADEMARK OFFICE

CERTIFICATE OF CORRECTION

PATENT NO. : 5,074,067
DATED : December 24, 1991
INVENTOR(S) : Richard M. Cohart It is certified that error appears in the above-indentified patent and that said Letters Patent is hereby corrected as shown below:

Column 5, line 19, change "copending" to --opening --.

Signed and Sealed this

First Day of March, 1994

*Attest:*

*Attesting Officer*

BRUCE LEHMAN

*Commissioner of Patents and Trademarks*